US007610920B2

(12) United States Patent
Fournier et al.

(10) Patent No.: US 7,610,920 B2
(45) Date of Patent: Nov. 3, 2009

(54) THIOL-FUNCTIONALIZED SORBENT FOR SMOKING ARTICLES AND FILTERS FOR THE REMOVAL OF HEAVY METALS FROM MAINSTREAM SMOKE

(75) Inventors: Jay A Fournier, Richmond, VA (US); Zhaohua Luan, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 539 days.

(21) Appl. No.: 10/740,586

(22) Filed: Dec. 22, 2003

(65) Prior Publication Data

US 2005/0133050 A1 Jun. 23, 2005

(51) Int. Cl.
*A24D 3/06* (2006.01)

(52) U.S. Cl. ..... 131/334; 131/331; 131/341; 131/202; 131/352

(58) Field of Classification Search ..... None
See application file for complete search history.

(56) References Cited

U.S. PATENT DOCUMENTS

| | | | | |
|---|---|---|---|---|
| 2,881,770 A | | 4/1959 | Touey | |
| 2,882,243 A | | 4/1959 | Milton | |
| 2,882,244 A | | 4/1959 | Milton | |
| 3,055,654 A | | 9/1962 | Harrison et al. | |
| 3,101,723 A | | 8/1963 | Seligman et al. | |
| 3,130,007 A | | 4/1964 | Breck | |
| 3,247,195 A | | 4/1966 | Kerr | |
| 3,291,139 A | * | 12/1966 | Burke, Jr. et. al. | 131/334 |
| 3,292,636 A | | 12/1966 | Mays | |
| 3,308,069 A | | 3/1967 | Wadlinger et al. | |
| 3,314,752 A | | 4/1967 | Kerr | |
| 3,327,718 A | | 6/1967 | Kilburn | |
| 3,353,543 A | | 11/1967 | Sproull et al. | |
| 3,572,348 A | | 3/1971 | Norman et al. | |

(Continued)

FOREIGN PATENT DOCUMENTS

EP 0 532 329 A2 3/1991

(Continued)

OTHER PUBLICATIONS

A. M. Liu, K. Hidajat, S. Kawi and D. Y. Zhaob, a new class of hybrid mesoporous materials with functionalized organic monolayers for selective adsorption of heavy metal ions, 2000, RSC Publishing, Chem. Commun., 1145-1146.*

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Smoking articles which use thiol-functionalized sorbents are provided. The thiol-functionalized sorbents comprise at least one thioalkylsilyl compound covalently bound to an inorganic molecular sieve substrate, where the thiol-functionalized sorbent is capable of removing at least one heavy metal constituent of mainstream smoke. The thiol-functionalized sorbents are particularly useful for the removal of mercury and/or cadmium from mainstream smoke. Methods for making cigarette filters and smoking articles using the thiol-functionalized sorbent, as well as methods for smoking a cigarette comprising the thiol-functionalized sorbent, are also provided.

42 Claims, 3 Drawing Sheets

U.S. PATENT DOCUMENTS 3,702,886 A 11/1972 Argauer et al.
3,703,901 A 11/1972 Norman et al.
4,022,223 A 5/1977 Rainer et al.
4,148,864 A 4/1979 Groth et al.
4,177,822 A 12/1979 Bryant, Jr. et al.
4,203,952 A 5/1980 Hancock et al.
4,236,533 A 12/1980 De Clara
4,246,009 A 1/1981 Sawada et al.
4,246,910 A 1/1981 Rainer et al.
4,252,687 A 2/1981 Dale et al.
4,256,609 A 3/1981 Dale et al.
4,317,460 A * 3/1982 Dale et al. ..... 131/334
4,397,321 A 8/1983 Stuetz
4,481,958 A 11/1984 Rainer et al.
4,604,110 A 8/1986 Frazier
4,662,384 A 5/1987 Green
4,964,426 A 10/1990 Lee et al.
4,982,000 A 1/1991 Earl et al.
5,098,684 A 3/1992 Kresge et al.
5,102,643 A 4/1992 Kresge et al.
5,108,725 A 4/1992 Beck et al.
5,120,692 A 6/1992 Beck
5,149,435 A 9/1992 Laube
5,150,723 A 9/1992 Lee et al.
5,204,376 A 4/1993 Henmi et al.
5,212,131 A 5/1993 Belding
5,258,340 A 11/1993 Augustine et al.
5,261,948 A 11/1993 Foley et al.
5,278,112 A 1/1994 Klatte
5,322,075 A 6/1994 Deevi et al.
5,360,023 A 11/1994 Blakley et al.
5,362,695 A 11/1994 Beck et al.
5,376,348 A 12/1994 Stoilov et al.
5,396,909 A 3/1995 Gentry et al.
5,397,500 A 3/1995 Lee
5,404,890 A 4/1995 Gentry et al.
5,482,915 A 1/1996 Golden et al.
5,499,636 A 3/1996 Baggett, Jr. et al.
5,540,759 A 7/1996 Golden et al.
5,568,819 A 10/1996 Gentry et al.
5,591,368 A 1/1997 Fleischhauer et al.
5,657,772 A 8/1997 Duke et al.
5,666,976 A 9/1997 Adams et al.
5,692,525 A 12/1997 Counts et al.
5,692,526 A 12/1997 Adams et al.
5,727,573 A * 3/1998 Meier et al. ..... 131/341
5,738,793 A 4/1998 Janks et al.
5,833,739 A 11/1998 Klatte et al.
5,915,387 A 6/1999 Baggett, Jr. et al.
5,934,289 A 8/1999 Watkins et al.
5,972,079 A 10/1999 Foley et al.
5,985,790 A 11/1999 Moskovitz et al.
5,988,176 A 11/1999 Baggett, Jr. et al.
6,026,820 A 2/2000 Baggett, Jr. et al.
6,053,176 A 4/2000 Adams et al.
6,074,974 A 6/2000 Lee et al.
6,117,810 A 9/2000 Lee et al.
6,119,699 A 9/2000 Sung
6,168,773 B1 1/2001 Sharp
6,209,547 B1 4/2001 Koller et al.
6,261,986 B1 7/2001 Bowman et al.
6,541,653 B2 * 4/2003 Chuang et al. ..... 560/24
2001/0012820 A1 8/2001 Nishijima et al.
2003/0176396 A1 * 9/2003 Shea et al. ..... 514/63

FOREIGN PATENT DOCUMENTS

WO WO0025611 * 11/2000

OTHER PUBLICATIONS

U.S. Department of Health and Human Services, "Toxicological Profile for Cadmium", Jul. 1999, pp. 3-4, 126, 129, http://www.atsdr.cdc.gov/toxprofiles/tp5.pdf, accessed Dec. 8, 2007.*
Borgerding et al., "Analysis of complex mixtures—Cigarette smoke", 2005, Elsevier, Experimental and Toxicologic Pathology 57, 43-73. See pp. 54-65 and table 8.*
"Cationic Surfactant", http://www.orica.com.au/Business%5...CE75A4A2567D002000D6?OpenDocument, printed Aug. 7, 2001.
"Surfactant-Modified Zeolite (SMZ)-A Versatile, Inexpensive Sorbent for Removing Contaminants from Water", http://www.ees.nmt.edu/Hydro/faculty/Bowman/Research/zeopage/smz.html, printed Jul. 31, 2001.
Zhaohui Li et al., Sorption of Ionizable Organic Solutes by Surfactant-Modified Zeolite, Enviroin. Sci. Technol. 2000, vol. 34, pp. 3756-3760.
Zhaohui Li et al., "Enhanced Reduction of Chromate and PCE by Pelletized Surfactant-Modified Zeolite/Zerovalent Iron", Environ. Sci. Technol. 1999, vol. 33, pp. 4326-4330.
Zhaohui Li et al., "Counterion Effects on the Sorption of Cationic Surfactant and Chromate on Natural Clinoptilolite", Environ. Sci. technol. 1997, vol. 31, pp. 2407-2412.
Gaydardjief S. et al., "Adsorption of Oxyanions with Surface Modified Zeolites", Acta Metallurgica Slovaca, 4, Special Issue Apr. 2001, pp. 51-57.
Robert S. Bowman, "Surfactant-Altered Zeolites as Permeable Barriers for In Situ Treatment of Contaminated Groundwater", Department of EArth and Environmental Sciences, New Mexico Tech.
Robert S. Bowman, "SMZ + Microorganisms for Combined Sorption/Biodegradation", http://www.ees.nmt.edu/bowman/research/SMZ/SMZBiodegrad.html, printed Aug. 12, 2002.
Robert S. Bowman, "SMZ/ZVI Permeable Barrier Pilot Test", http://www.ees.nmt.edu/bowman/research/SMZ/SMZZVIPilotTest.html, printed Aug. 12, 2002.
Robert S. Bowman, "SMZ for Removal of Pathogens from Sewage", http://www.ees.nmt.edu/bowman/research/SMZ/Pathogens.html, printed Aug. 12, 2002.
Robert S. Bowman, "SMZ/ZVI Pellets for Combined Sorption/Reduction", http://www.ees.nmt.edu/bowman/research/SMZ/SMZZVIProp.html, printed Aug. 12, 2002.
Robert S. Bowman, "SMZ for Treatment of Oil Field Wastewaters", http://www.ees.nmt.edu/bowman/research/SMZ/ProdWater.html, printed Aug. 12, 2002.
Robert S. Bowman, "SMZ Permeable Barrier Test Facility", http://www.ees.nmt.edu/bowman/research/SMZ/PilotTestFacility.html, printed Aug. 12, 2002.
Robert S. Bowman, "SMZ Permeable Barrier Test Results", http://www.ees.nmt.edu/bowman/research/SMZ/SMZPilotTest.html, printed Aug. 12, 2002.
Robert S. Bowman, Mechanisms of Surfactant and Contaminant Sorption by SMZ, http://www.ees.nmt.edu/bowman/research/SMZ/SMZSorpMech.html, printed Aug. 12, 2002.
Robert S. Bowman, "Zeolite-Surfactant Interactions", http://www.ees.nmt.edu/bowman/research/SMZ/ZeoSurfInt.html, printed Aug. 12, 2002.
Robert S. Bowman, "Surfactant-Modified-Zeolites (SMA) and their Applications to Environmental Remediation", http://www.ees.nmt.edu/bowman/research/SMZ/, printed Aug. 12, 2002.
Robert S. Bowman, "Properties of Zeolites", http://www.ees.nmt.edu/bowman/research/SMZ/ZeoProp.html, printed Aug. 12, 2002.
Robert S. Bowman, "Sorption of Anions, Cations, and Neutral Organics by SMA", http://www.ees.nmt.edu/bowman/research/SMZ/SMZSorp.html, printed Aug. 12, 2002.

* cited by examiner

THIOL-FUNCTIONALIZED SORBENT FOR SMOKING ARTICLES AND FILTERS FOR THE REMOVAL OF HEAVY METALS FROM MAINSTREAM SMOKE

BACKGROUND

A variety of filter materials have been suggested for construction of cigarette filters, including cotton, paper, cellulose, and certain synthetic fibers. However, such filter materials generally only remove particulate and condensable components from tobacco smoke. As a result, they may often be less than optimal for the removal of gaseous or semi-volatile components from tobacco smoke.

SUMMARY

Thiol-functionalized sorbents suitable for removing heavy metals from mainstream smoke are provided. Preferably, the thiol-functionalized sorbent is capable of substantially removing mercury from tobacco smoke, and/or capable of substantially removing cadmium from mainstream smoke.

In an embodiment, a smoking article is provided, which comprises a thiol-functionalized sorbent having at least one thioalkylsilyl compound covalently bound to an inorganic molecular sieve substrate, wherein the thiol-functionalized sorbent is capable of removing at least some of at least one heavy metal constituent of mainstream smoke. Preferably, the thiol-functionalized sorbent is capable of removing most of the mercury, or most of the cadmium. Most preferably, substantially all of the mercury and/or substantially all of the cadmium is removed. Examples of smoking articles include, but are not limited to a cigarette, a pipe, a cigar, and a non-traditional cigarette. Preferably, the smoking article is a cigarette. In an embodiment, the thiol-functionalized sorbent is located in a filter of the smoking material.

In another embodiment, a cigarette filter is provided, which comprises a thiol-functionalized sorbent having at least one thioalkylsilyl compound covalently bound to an inorganic molecular sieve substrate, and wherein the thiol-functionalized sorbent is capable of removing at least one heavy metal constituent of mainstream smoke. Preferably, the filter is selected from the group consisting of a mono filter, a dual filter, a triple filter, a cavity filter, a recessed filter and a free-flow filter.

In another preferred embodiment, the filter comprises cellulose acetate tow, cellulose paper, mono cellulose, mono acetate, and combinations thereof. Preferably, the thiol-functionalized sorbent is incorporated into one or more cigarette filter parts selected from the group consisting of shaped paper insert, a plug, a space, cigarette filter paper, or a free-flow sleeve. In a further embodiment, the thiol-functionalized sorbent is incorporated with cellulose acetate fibers forming a plug or a free-flow filter element. In yet another embodiment, the thiol-functionalized sorbent is incorporated with polypropylene fibers forming a plug or free-flow filter element.

In an embodiment, the thiol-functionalized sorbent is incorporated in at least one of a mouthpiece filter plug, a first tubular filter element adjacent to the mouthpiece filter plug, and a second tubular-filter element adjacent to the first tubular element. In another embodiment, the thiol-functionalized sorbent is incorporated in at least one part of a three-piece filter including a mouthpiece filter plug, a first filter plug adjacent to the mouthpiece filter plug, and a second filter plug adjacent to the first filter plug.

In another embodiment, methods for making a cigarette filter are provided, which comprise incorporating a thiol-functionalized sorbent into a cigarette filter, wherein the thiol-functionalized sorbent comprises at least one thioalkylsilyl compound covalently bound to inorganic molecular sieve substrate.

In another embodiment, methods of making a cigarette are provided, which comprise: (i) providing a cut filler to a cigarette making machine to form a tobacco column; (ii) placing a paper wrapper around the tobacco column to form a tobacco rod; and (iii) attaching a cigarette filter containing a thiol-functionalized sorbent to the tobacco rod using tipping paper to form the cigarette.

In another embodiment, methods of smoking a cigarette are provided, which comprise lighting the cigarette to form smoke and drawing the smoke through the cigarette, wherein during the smoking of the cigarette, the thiol-functionalized sorbent is capable of removing at least some of at least one heavy metal constituent of mainstream smoke. Preferably, the thiol-functionalized sorbent substantially removes mercury from tobacco smoke and/or substantially removes cadmium from tobacco smoke.

In an embodiment, a cut filler composition is provided, which comprises tobacco and a thiol-functionalized sorbent having at least one thioalkylsilyl compound covalently bound to an inorganic molecular sieve substrate, wherein the thiol-functionalized sorbent is capable of removing at least one heavy metal constituent of mainstream smoke.

Preferably, the inorganic molecular sieve substrate is selected from the group consisting of zeolite, aluminophosphate, mesoporous silicate, mesoporous aluminosilicate, and mixtures thereof. In an embodiment, the inorganic molecular sieve substrate comprises mesoporous or microporous molecular sieves. In an embodiment, the inorganic molecular sieve substrate comprises a zeolite. Preferably, the zeolite is selected from the group consisting of zeolite ZSM-5, zeolite A, zeolite X, zeolite Y, zeolite K-G, zeolite ZK-5, zeolite Beta, zeolite ZK-4, and mixtures thereof, and most preferably selected from the group consisting of zeolite ZSM-5, zeolite Y, and mixtures thereof. In another embodiment, the thiol-functionalized sorbent comprises 3-thiopropylsilane covalently bound to a zeolite.

In another embodiment, the thiol-functionalized sorbent comprises a silicate material. In a further embodiment, the thiol-functionalized sorbent comprises 3-thiopropylsilane covalently bound to a mesoporous silicate.

In a further embodiment, the thioalkylsilyl group is covalently bound on both exterior and interior surfaces of the molecular sieve and wherein the molecular sieve is a mesoporous molecular sieve. Preferably, the thiol-functionalized molecular sieve comprises a thioalkyl group having more than three carbons.

Preferably, the thiol-functionalized sorbent is in granular form having a particle size from about 20 mesh to about 60 mesh.

In a preferred embodiment, the smoking articles and cigarette filters will comprise from about 10 mg to about 300 mg of the thiol-functionalized sorbent, or more preferably from about 100 mg to about 200 mg of the thiol-functionalized sorbent.

DETAILED DESCRIPTION

Figure 1:
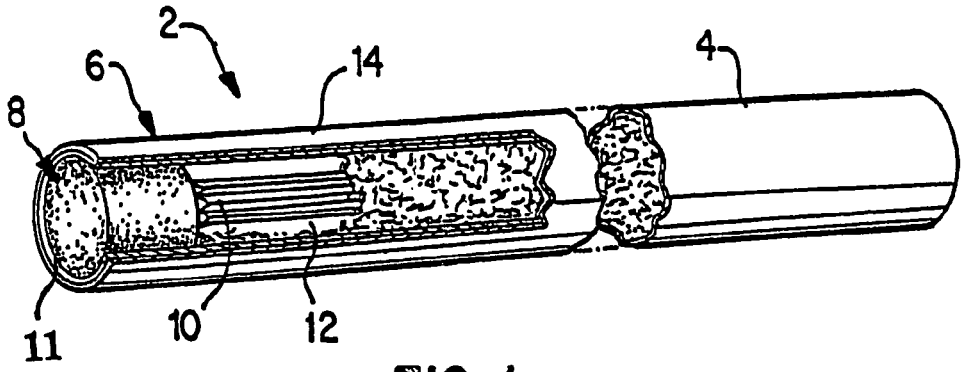
FIG. 1 is a partially broken-away perspective view of a cigarette incorporating one embodiment wherein folded paper containing thiol-functionalized sorbent is inserted into a hollow portion of a tubular filter element of the cigarette.

Smoking articles and methods for removing heavy metals from mainstream smoke, which involve the use of thiol-functionalized sorbents, are provided. A thiol-functionalized sorbent comprises at least one compound comprising a sulfhydryl (—SH) group covalently bonded to an inorganic molecular sieve. In a preferred embodiment, the thiol-functionalized sorbent selectively removes heavy metals from tobacco smoke, while minimizing reduction of other constituents of mainstream smoke, such as those that contribute to flavor.

Smoking articles, such as cigarettes, pipes, and cigars, as well as non-traditional cigarettes, also are provided. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636. The thiol-functionalized sorbent can be incorporated into a filter arrangement for such cigarettes.

Heavy metals usually have an atomic weight greater than sodium. Heavy metals of particular interest which may be removed include, but are not limited to, mercury and cadmium. The term "mainstream" smoke includes the mixture of gases, vapors and particulates passing through a smoking mixture and issuing through the filter end, i.e., the smoke issuing or drawn from the mouth end of a smoking article for example during smoking of a cigarette.

The term "sorption" denotes filtration through absorption and/or adsorption. Sorption is intended to cover interactions on the outer surface of the sorbent, as well as interactions within the pores, such as channels or cavities, of the sorbent. In other words, a sorbent is a substance that has the ability to condense or hold molecules of other substances on its surface and/or the ability to take up another substance, i.e. through penetration of the other substance into its inner structure or into its pores. The term adsorption also denotes filtration through physical sieving, i.e. capture of certain constituents in the pores of the sorbent. The term "sorbent" as used herein refers to either an adsorbent, an absorbent, or a substance that functions as both an adsorbent and an absorbent.

The term "molecular sieve" as used herein refers to an inorganic porous material such as silica gels, natural or synthetic aluminosilicates such as zeolites, or mesoporous silicates. The term "microporous molecular sieves" generally refers to such materials having pore sizes of about 20 Å or less. The term "mesoporous molecular sieves" generally refers to such materials with pore sizes of about 20-500 Å, preferably 20 to 300 Å. Materials with pore sizes of about 500 Å or larger may be referred to as "macroporous." While solid inorganic material having surface hydroxyl groups may be used as a substrate, porous materials are preferred.

Exemplary microporous molecular sieves include zeolites as described, for example, in U.S. Pat. No. 3,702,886 (zeolite ZSM-5), U.S. Pat. No. 2,882,243 (zeolite A), U.S. Pat. No. 2,882,244 (zeolite X), U.S. Pat. No. 3,130,007 (zeolite Y), U.S. Pat. No. 3,055,654 (zeolite K-G), U.S. Pat. No. 3,247,195 (zeolite ZK-5), U.S. Pat. No. 3,308,069 (zeolite Beta), U.S. Pat. No. 3,314;752 (zeolite ZK-4). A source of natural zeolite in North America is the St Cloud Mining Company, Truth or Consequences, N.M. Preferred characteristics of zeolite include a well defined pore size, and relatively high Si:Al ratio, preferably in the range 2.5-100, and more preferably in the range 10-50. Preferred zeolites include ZSM-5 and Y-type zeolites.

Examples of mesoporous and macroporous substrates include mesoporous silicates, mesoporous aluminosilicates, and silica gels. Mesoporous silicates are described, for example, in patents relating to MCM-41 and MCM-48 and SBA-15; such as U.S. Pat. Nos. 5,098,684, 5,102,643 and 5,108,725, hereby incorporated in their entirety. Silica gel materials may be made using any suitable method, such as the methods described, for example, in U.S. Pat. Nos. 4,148,864; 5,376,348 and 6,168,773 and the patents referenced therein, which are hereby incorporated in their entirety. Mesoporous and macroporous molecular sieves, such as mesoporous silicates, mesoporous aluminosilicates, silica gel and related materials are preferred substrates for making the thiol-functionalized sorbent. The larger pores of mesoporous silicates and mesoporous aluminosilicates may allow extensive coating of the interior surfaces of the pores. By selecting one or more thiol-functionalized compounds to be incorporated into the sorbent material, the pore size may be adjusted and the selectivity of the sorbent material may be thereby enhanced.

The thiol functional group is preferably part of a thioalkylsilyl group, such as a thiopropylsilyl group, more preferably a 3-thiopropylsilyl group, and most preferably those groups having more than three carbons. If desired, more than one thioalkylsilyl compound may be combined with the substrate material.

Methods and examples for making a thiol-functionalized sorbent are disclosed, for example, in U.S. Pat. No. 4,203,952 to Hancock et al. which is incorporated herein in its entirety. The thiol-functional compound can be bound on either the interior surfaces of the molecular sieves, the exterior surfaces, or both.

In one example, a thiol-functionalized sorbent can be made by mixing a thioalkyltriethoxysilane (such as $HS(CH_2)_nSi(OCH_2CH_3)_3$; where n=2 to 20), preferably 3-thiopropyltriethoxysilane, with a mesoporous silicate in a water and ethanol solvent. Other solvents, such as toluene, can also be used and may be required to dissolve longer alkyls. The mixture is heated for several hours to allow the thioalkyltriethoxysilane to react with and chemically bond to the silicate surface. The reaction mixture is then decanted to obtain a reaction product comprising the thiol-functionalized sorbent. The reaction product is subsequently rinsed with a solvent, and dried in an oven at an elevated temperature, for example around 100° C.

Although the rinsing and drying steps are optional, the drying step is preferred. The above procedure may also be practiced with other thioalkyltrialkoxysilanes, such as a thioalkyltrimethoxysilane.

The thiol-functionalized molecular sieve can also be prepared by the following alternative procedure. A suspension of mesoporous silicates, mesoporous aluminosilicates, or silica gel is rapidly stirred in a solution of water and ethanol. To that mixture is added 3-thiopropyltriethoxysilane. The 3-thiopropyltriethoxysilane can be added before, during, or after heating. The 3-thiopropyltrialkoxysilane is preferably pre-diluted with anhydrous ethanol. The resulting mixture is then heated, preferably to the boiling point. In a preferred embodiment, the ethanol is distilled off and replaced with water. The solids are isolated by a procedure such as filtration and with an optional solvent rinse, preferably water. The solids are then heated in an oven until water loss has proceeded to equilibrium with the surroundings. Typical heating conditions are heating overnight at about 105° C.

In another example, mesoporous silicate, mesoporous aluminosilicate, silica gel, or zeolite may be combined with thioalkyltrimethoxysilane in toluene and stirred at reflux for about 3 hours. Alcohol produced in this time may be collected and removed. After cooling, the product may be extracted with dry methanol for about 24 hours and thereafter dried in vacuo.

In yet another example, molecular sieve materials can be functionalized with thiol groups via incipient-wetness. Molecular sieve powder is added to a dry toluene solution containing dissolved thioalkyltrimethoxysilane followed by magnetic stirring or vigorous shaking at room temperature. The thioalkyltrimethoxysilane concentration in the solution varies depending on the desired loading of thiol groups. The mixture is then transferred into a sealed Teflon container and heated at approximately 100° C. for about twenty-four hours. The final solid product is filtered, washed with dry toluene followed by dichloromethane, and dried at approximately 120° C. for about twelve hours.

Not wishing to be bound by theory, it is believed that in the reaction of silica gel with 3-thiopropyltriethoxysilane (or other 3-thioalkyltrialkoxysilanes), the ethoxy groups are replaced with hydroxyl so that a 3-thiopropyltrihydroxysilane intermediate is obtained, which then reacts with exposed Si—OH groups to produce a thiol-functionalized molecular sieve product. Curing can cause the loss of hydroxyl groups to produce predominantly doubly linked silicon anchors for the reactive group.

In a preferred embodiment, the thiol-functionalized sorbent is capable of substantially removing mercury and, to a lesser extent, cadmium from mainstream smoke. While not wishing to be bound by theory, the performance of the thiol-functionalized sorbent is believed to arise from the particular affinity of the thiol group for certain selected metals such as mercury and cadmium. Once removed by the thiol-functionalized sorbent, the heavy metal is not released back into the smoke stream because of the covalently bound thiol function group's ability to complex the metal. An embodiment wherein the inorganic substrate is a zeolite may be further advantageous for certain applications because unmodified internal pores of a microporous zeolite can be used to retain ion exchange and molecular trapping capacity for removing one or more constituents of tobacco smoke.

In an embodiment, the inorganic substrate is a mesoporous silicate or mesoporous aluminosilicate wherein thioalkylsilane molecules may modify interior and more protected surfaces of the substrate thereby increasing the thiol-functionalized surface area. The interior thioalkyl groups can be protected from constituents of tobacco smoke that are too large to enter the molecular sieve. In this embodiment, the thioalkylsilane group may be chosen so as to modify the pore size of the substrate and thereby tune the selectivity of the molecular sieve.

In one embodiment, the thiol-functionalized sorbent is incorporated into a filter. Any suitable filter design may be used, where the thiol-functionalized sorbent is capable of removing at least one heavy metal constituent of mainstream smoke including, but not limited to, a mono filter, a dual filter, a triple filter, a cavity filter, a recessed filter or a free-flow filter. Mono filters typically contain a variety of cellulose acetate tow or cellulose paper materials. Pure mono cellulose filters or paper filters offer good tar and nicotine retention, and are biodegradable. Dual filters can comprise a cellulose acetate mouth side and a pure cellulose segment or cellulose acetate segment, with a thiol-functionalized sorbent on the smoking material or tobacco side. The length and pressure drop of the two segments of the dual filter can be adjusted to provide optimal adsorption, while maintaining acceptable draw resistance. Triple filters may have mouth and tobacco side segments, while the middle segment comprises a material or paper containing the thiol-functionalized sorbent. Cavity filters have two segments, for example, acetate-acetate, acetate-paper or paper-paper, separated by a cavity containing the thiol-functionalized sorbent. Recessed filters have an open cavity on the mouth side, and contain the thiol-functionalized sorbent incorporated into the plug material. The filters may also optionally be ventilated, and/or comprise additional sorbents (such as charcoal, activated carbon and/or magnesium silicate), catalysts, flavorants or other additives for the cigarette filter.

In a preferred embodiment, the thiol-functionalized sorbent may be incorporated as a shaped article, particles, or powder, preferably having a particle size of 20-60 mesh into a filter arrangement in the path of the smoke stream of a smoking article. The following descriptions illustrate exemplary embodiments.

FIG. 1 illustrates a cigarette 2 having a tobacco rod 4, a filter portion 6, and a mouthpiece filter plug 8. Thiol-functionalized sorbent can be loaded onto folded paper 10 inserted into a hollow cavity such as the interior of a free-flow sleeve 12 forming part of the filter portion 6.

Figure 2:
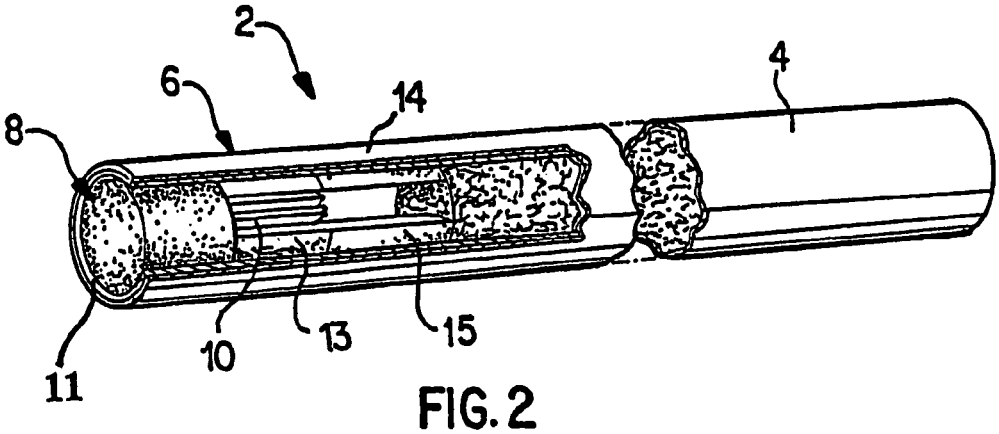
FIG. 2 is a partially broken-away perspective view of another embodiment wherein thiol-functionalized sorbent is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of the thiol-functionalized sorbent can be provided in the cigarette filter portion by a combination of the coated amount of reagent/area of the paper and/or the total area of coated paper employed in the filter (e.g., higher amounts of thiol-functionalized sorbent can be provided simply by using larger pieces of coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

Thiol-functionalized sorbent can be incorporated into the filter paper in a number of ways. For example, thiol-functionalized sorbent can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape and inserted into a filter portion of the cigarette.

For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively, the thiol-functionalized sorbent can be added to the filter paper during the paper-making process. For example, thiol-functionalized sorbent can be mixed with bulk cellulose to form a cellulose pulp mixture. The mixture can be then formed into filter paper according to any suitable method.

Figure 3:
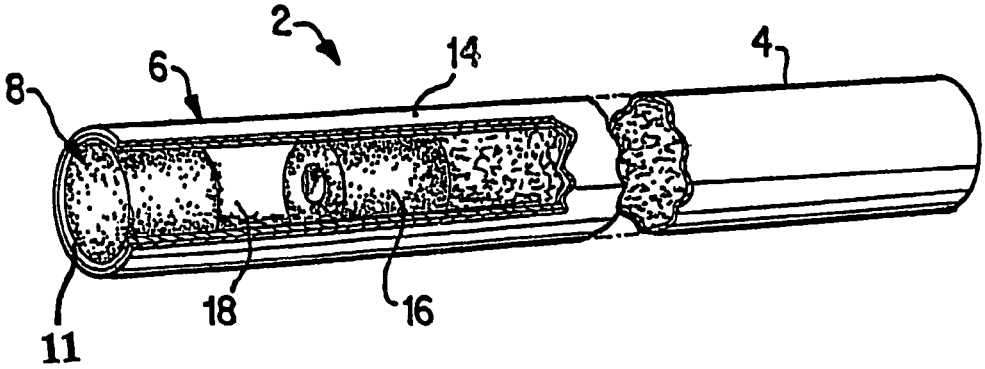
FIG. 3 is a partially broken-away perspective view of another embodiment wherein thiol-functionalized sorbent is incorporated in a plug-space-plug filter element.

In another preferred embodiment, thiol-functionalized sorbent is incorporated into the fibrous material of the cigarette filter portion itself. Such filter materials include, but are not limited to, fibrous filter materials including paper, cellulose acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14; The filter portion 6 may include a filter overwrap 11. The filter overwrap 11 containing traditional fibrous filter material and thiol-functionalized sorbent can be incorporated in or on the filter overwrap 11 such as by being coated thereon. Alternatively, thiol-functionalized sorbent can be incorporated in the mouthpiece filter 8, in the plug 16, and/or in the space 18. Moreover, thiol-functionalized sorbent can be incorporated in any element of the filter portion of a cigarette. For example, the filter portion may consist only of the mouthpiece filter 8 and thiol-functionalized sorbent can be incorporated in the mouthpiece filter 8 and/or in the tipping paper 14.

Figure 4:
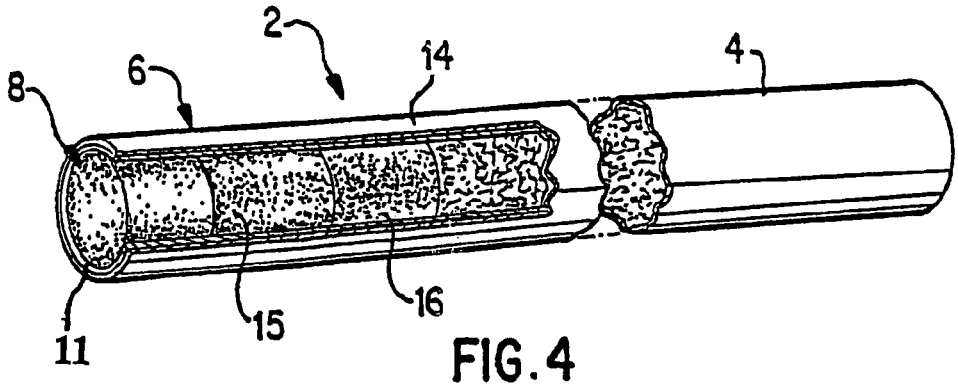
FIG. 4 is a partially broken-away perspective view of another embodiment wherein thiol-functionalized sorbent is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of the thiol-functionalized sorbent or a plug 15 made of material such as fibrous polypropylene or cellulose acetate containing thiol-functionalized sorbent. As in the previous embodiment, the plug 16 can be hollow or solid and the tobacco rod 4 and filter portion 6 are joined together with tipping paper 14. There is also a filter overwrap 11.

Figure 5:
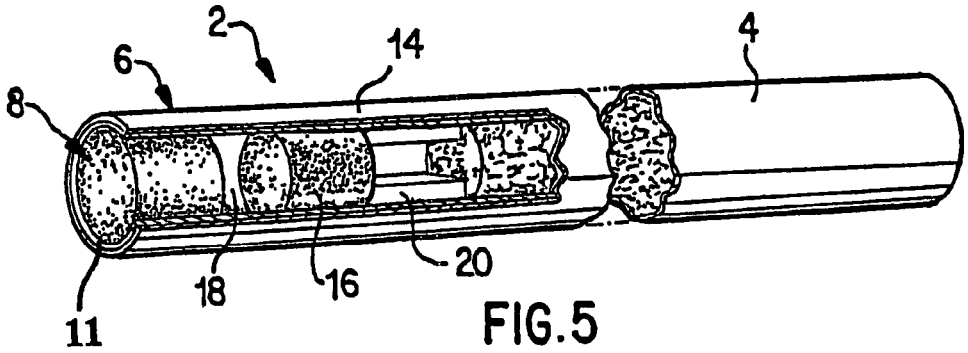
FIG. 5 is a partially broken-away perspective view of another embodiment wherein thiol-functionalized sorbent is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. Thiol-functionalized sorbent can be incorporated into one or more elements of the filter portion 6. For instance, thiol-functionalized sorbent can be incorporated into the sleeve 20 or granules of thiol-functionalized sorbent can be filled into the space within the sleeve 20. If desired, the plug 16 and sleeve 20 can be made of material such as fibrous polypropylene or cellulose acetate containing thiol-functionalized sorbent. As in the previous embodiment, the plug 16 can be hollow or solid.

Figure 6:
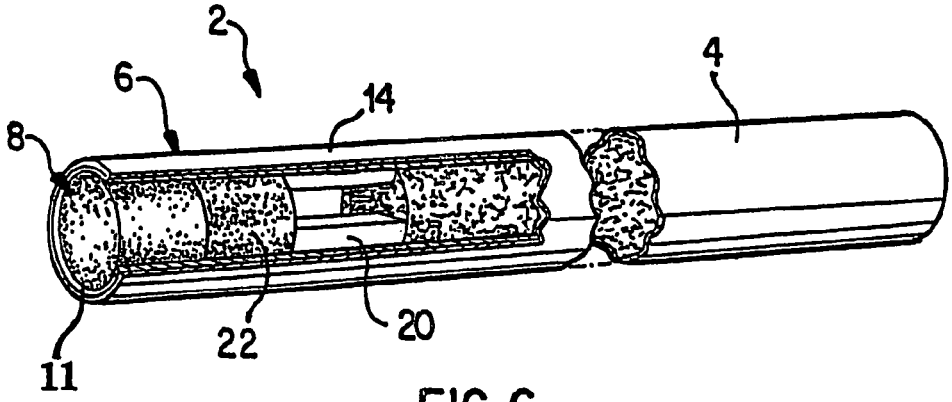
FIG. 6 is a partially broken-away perspective view of another embodiment wherein thiol-functionalized sorbent is incorporated in a three-part filter element having two plugs and a hollow sleeve.
Figure 7:
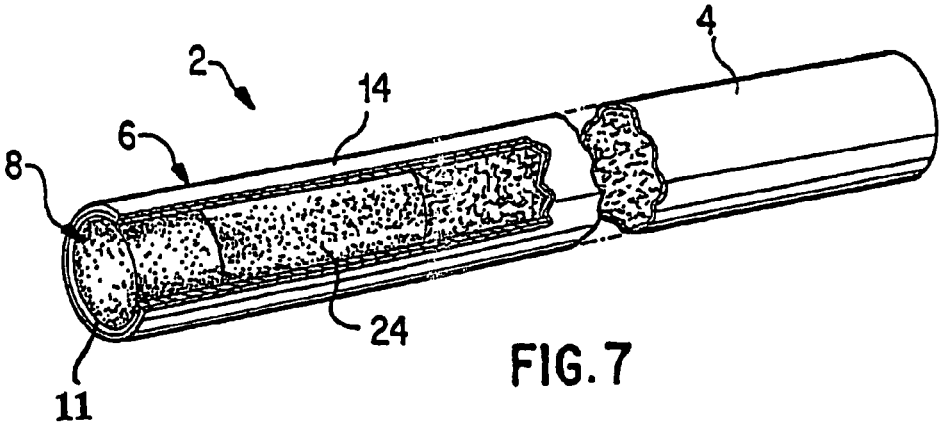
FIG. 7 is a partially broken-away perspective view of another embodiment wherein thiol-functionalized sorbent is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and thiol-functionalized sorbent can be incorporated in one or more of these filter elements. In FIG. 7, the filter portion 6 includes a mouthpiece filter 8 and a plug 24, and thiol-functionalized sorbent can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply thiol-functionalized sorbent to filter fibers or other substrate supports. For example, thiol-functionalized sorbent can be added to the filter fibers before they are formed into a filter cartridge, e.g., a tip for a cigarette. Thiol-functionalized sorbent can be added to the filter fibers, for example, in the form of a dry powder or a slurry. If thiol-functionalized sorbent is applied in the form of a slurry, the fibers are allowed to dry before they are formed into a filter cartridge.

In another preferred embodiment, thiol-functionalized sorbent is employed in a hollow portion of a cigarette filter. For example, some cigarette filters have a plug/space/plug configuration in which the plugs comprise a fibrous filter material and the space is simply a void between the two filter plugs, which can be filled with the thiol-functionalized sorbent. An example of this embodiment is shown in FIG. 3. The thiol-functionalized sorbent can be in granular form or can be loaded onto a suitable support such as a fiber or thread.

Figure 8:
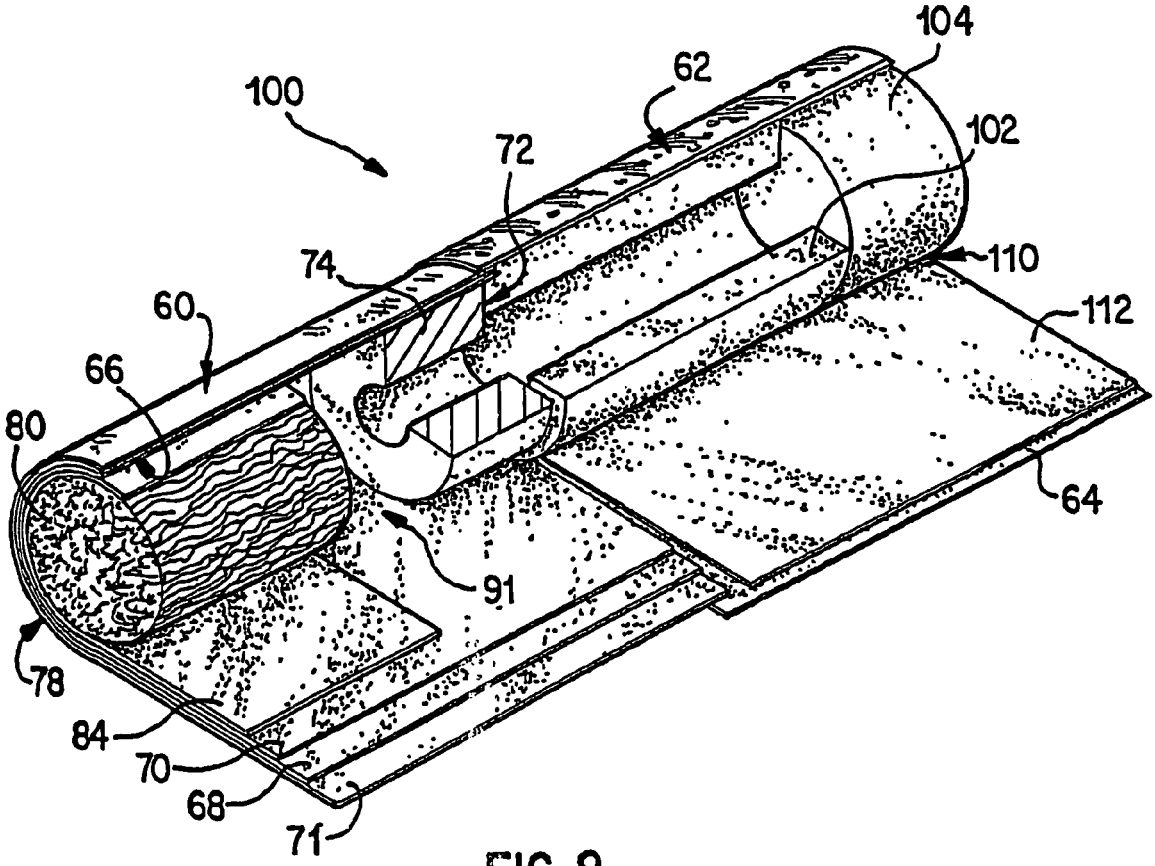
FIG. 8 is a partially broken-away perspective view of another embodiment wherein thiol-functionalized sorbent is incorporated in a filter element which may be used in a smoking article.

In another embodiment, the thiol-functionalized sorbent is employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the thiol-functionalized sorbent.

In such a cigarette, thiol-functionalized sorbent can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, thiol-functionalized sorbent can be incorporated into the fibrous wall portions of the tubular free-flow filter element 102 itself. For instance, the tubular free-flow filter element or sleeve 102 can be made of suitable materials such as polypropylene or cellulose acetate fibers and thiol-functionalized sorbent can be mixed with such fibers prior to or as part of the sleeve forming process.

In another embodiment, thiol-functionalized sorbent can be incorporated into the mouthpiece filter plug 104 instead of in the element 102. However, as in the previously described embodiments, thiol-functionalized sorbent may be incorporated into more than one constituent of a filter portion such as by being incorporated into the mouthpiece filter plug 104 and into the tubular free-flow filter element 102.

The filter portion 62 of FIG. 8 can also be modified to create a void space into which thiol-functionalized sorbent can be inserted.

As explained above, thiol-functionalized sorbent can be incorporated in various support materials. When particles of thiol-functionalized sorbent are used in filter paper, the particles may have an average particle diameter of up to 100 μm, preferably 2 to 50 μm. When thiol-functionalized sorbent is used in granular form, larger particles may be used. Such particles preferably have a mesh size from 20 to 60, and more preferably from 35 to 60 mesh.

The amount of thiol-functionalized sorbent employed in the cigarette filter by way of incorporation on a suitable support such as filter paper and/or filter fibers depends on the amount of constituents in the tobacco smoke and the amount of selected constituents to be removed. As an example, the filter paper and the filter fibers may contain from 10% to 50% by weight of the thiol-functionalized sorbent. In the case of a cigarette, the tobacco rod or filter may contain from about 10 mg to about 300 mg, and more preferable from about 100 mg to about 200 mg of the thiol-functionalized sorbent.

A method of making a cigarette filter comprises incorporating a thiol-functionalized sorbent into a cigarette filter, wherein the thiol-functionalized sorbent comprises at least one thioalkylsilyl compound covalently bound to inorganic molecular sieve substrate. Any conventional or modified method of making cigarette filters may be used to incorporate the thiol-functionalized sorbent.

Another embodiment relates to methods for making cigarettes. In one embodiment, the method comprises: (i) providing a cut filler to a cigarette making machine to form a tobacco column; (ii) placing a paper wrapper around the tobacco column to form a tobacco rod; and (iii) attaching a cigarette filter incorporating the thiol-functionalized sorbent to the tobacco rod to form the cigarette.

Examples of suitable types of tobacco materials which may be used include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. Tobacco substitutes may also be used.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.).

Cigarettes incorporating the thiol-functionalized sorbent can be manufactured to any desired specification using standard or modified cigarette making techniques and equipment. The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

Yet another embodiment relates to methods of smoking the cigarette described above, which involve lighting the cigarette to form smoke and drawing the smoke through the cigarette, wherein during the smoking of the cigarette, the thiol-functionalized sorbent is capable of preferentially removing one or more selected constituents from mainstream smoke.

"Smoking" of a cigarette means the heating or combustion of the cigarette to form smoke, which can be drawn through the cigarette. Generally, smoking of a cigarette involves lighting one end of the cigarette and drawing the cigarette smoke through the mouth end of the cigarette, while the tobacco contained therein undergoes a combustion reaction. However, the cigarette may also be smoked by other techniques. For example, the cigarette may be smoked by heating the cigarette and/or heating using an electrical heater, as described for example, in commonly-assigned U.S. Pat. Nos. 6,026,820; 5,988,176; 5,915,387; 5,692,526; 5,692,525; 5,666,976; and 5,499,636.

While the invention has been described in detail with reference to preferred embodiments thereof, it will be apparent to one skilled in the art that various changes can be made, and equivalents employed, without departing from the scope of the invention.

All of the above-mentioned references are herein incorporated by reference in their entirety to the same extent as if each individual reference was specifically and individually indicated to be incorporated herein by reference in its entirety.

What is claimed is:

1. A smoking article comprising a thiol-functionalized sorbent having at least one thioalkylsilyl compound covalently bound to an inorganic molecular sieve substrate, wherein the thiol-functionalized sorbent is located in a filter and is present in an amount effective for removing cadmium from mainstream smoke, and wherein the smoking article is selected from the group consisting of a cigarette, a pipe, a cigar and a non-traditional cigarette.

2. The smoking article of claim 1, wherein the smoking article is a cigarette.

3. The smoking article of claim 1, wherein the filter is selected from the group consisting of a mono filter, a dual filter, a triple filter, a cavity filter, a recessed filter, and a free-flow filter.

4. The smoking article of claim 1, wherein the inorganic molecular sieve substrate comprises mesoporous or microporous molecular sieves.

5. The smoking article of claim 1, wherein the inorganic molecular sieve substrate is selected from the group consisting of zeolite, aluminophosphate, mesoporous silicate, mesoporous aluminosilicate, and mixtures thereof.

6. The smoking article of claim 5, wherein the inorganic molecular sieve substrate comprises a zeolite.

7. The smoking article of claim 6, wherein the zeolite is selected from the group consisting of zeolite ZSM-5, zeolite A, zeolite X, zeolite Y, zeolite K-G, zeolite ZK-5, zeolite Beta, zeolite ZK-4, and mixtures thereof.

8. The smoking article of claim 7, wherein the zeolite is selected from the group consisting of zeolite ZSM-5, zeolite Y, and mixtures thereof.

9. The smoking article of claim 1, wherein the thiol-functionalized sorbent comprises 3-thiopropylsilane covalently bound to a zeolite.

10. The smoking article of claim 1, wherein the thiol-functionalized sorbent comprises a silicate material.

11. The smoking article of claim 1, wherein the thiol-functionalized sorbent comprises 3-thiopropylsilane covalently bound to a mesoporous silicate.

12. The smoking article of claim 1, wherein the thioalkylsilyl group is covalently bound on exterior and interior surfaces of the inorganic molecular sieve substrate and wherein the inorganic molecular sieve substrate is a mesoporous molecular sieve.

13. The smoking article of claim 1, wherein the thiol-functionalized sorbent comprises a thioalkylsilyl group having more than three carbons.

14. The smoking article of claim 1, wherein the thiol-functionalized sorbent is in granular form having a particle size from about 20 mesh to about 60 mesh.

15. The smoking article of claim 1, comprising from about 10 mg to about 300 mg of the thiol-functionalized sorbent.

16. The smoking article of claim 1, comprising from about 100 mg to about 200 mg of the thiol-functionalized sorbent.

17. A cigarette filter comprising a thiol-functionalized sorbent having at least one thioalkylsilyl compound covalently bound to an inorganic molecular sieve substrate, and wherein the thiol-functionalized sorbent is present in an amount effective for removing cadmium from mainstream smoke.

18. The cigarette filter of claim 17, wherein the inorganic molecular sieve substrate comprises mesoporous or microporous molecular sieves.

19. The cigarette filter of claim 17, wherein the inorganic molecular sieve substrate is selected from the group consisting of zeolite, aluminophosphate, mesoporous silicate, mesoporous aluminosilicate, and mixtures thereof.

20. The cigarette filter of claim 19, wherein the inorganic molecular sieve substrate comprises a zeolite.

21. The cigarette filter of claim 20, wherein the zeolite is selected from the group consisting of zeolite ZSM-5, zeolite A, zeobte X, zeolite Y, zeolite K-G, zeolite ZK-5, zeolite Beta, zeolite ZK-4, and mixtures thereof.

22. The cigarette filter of claim 21, wherein the zeolite is selected from the group consisting of zeolite ZSM-5, zeolite Y, and mixtures thereof

23. The cigarette filter of claim 17, wherein the thiol-functionalized sorbent comprises 3-thiopropylsilane covalently bound to a zeolite.

24. The cigarette filter of claim 17, wherein the thiol-functionalized sorbent comprises a silicate material.

25. The cigarette filter of claim 17, wherein the thiol-functionalized sorbent comprises 3-thiopropylsilane covalently bound to a mesoporous silicate.

26. The cigarette filter of claim 17, wherein the thioalkylsilyl group is covalently bound on exterior and interior surfaces of the inorganic molecular sieve substrate and wherein the molecular sieve is a mesoporous molecular sieve.

27. The cigarette filter of claim 17, wherein the thiol-functionalized sorbent comprises a thioalkylsilyl group having more than three carbons.

28. The cigarette filter of claim 17, wherein the thiol-functionalized sorbent is in granular form having a particle size from about 20 mesh to about 60 mesh.

29. The cigarette Filter of claim 17, comprising from about 10 mg to about 300 mg of the thiol-functionalized sorbent.

30. The cigarette filter of claim 17, comprising from about 100 mg to about 200 mg of the thiol-functionalized sorbent.

31. The cigarette filter of claim 17, wherein the filter is selected from the group consisting of a mono filter, a dual filter, a triple filter, a cavity filter, a recessed filter, and a free-flow filter.

32. The cigarette filter of claim 17, wherein the filter comprises cellulose acetate tow, cellulose paper, mono cellulose, mono acetate, and combinations thereof.

33. The cigarette filter of claim 17, wherein the thiol-functionalized sorbent is incorporated into one or more cigarette filter parts selected from the group consisting of shaped paper insert, a plug, a space, cigarette filter paper, and a free-flow sleeve.

34. The cigarette filter of claim 17, wherein the thiol-functionalized sorbent is incorporated with cellulose acetate fibers forming a plug or a free-flow filter element.

35. The cigarette filter of claim 17, wherein the thiol-functionalized sorbent is incorporated with polypropylene fibers forming a plug or free-flow filter element.

36. The cigarette filter of claim 17, wherein the thiol-functionalized sorbent is incorporated in at least one of a mouthpiece filter plug, a first tubular filter element adjacent to the mouthpiece filter plug, and a second tubular filter element adjacent to the first tubular element.

37. The cigarette filter of claim 17, wherein the thiol-functionalized sorbent is incorporated in at least one part of a three-piece filter including a mouthpiece filter plug, a first filter plug adjacent to the mouthpiece filter plug, and a second filter plug adjacent to the first filter plug.

38. A method of making a cigarette filter, the method comprising:

incorporating a thiol-functionalized sorbent into the cigarette filter of claim 17, wherein the thiol-functionalized sorbent comprises at least one thioalkylsilyl compound covalently bound to inorganic molecular sieve substrate.

39. The method of claim 38, wherein the filter is a mono filter, a dual filter, a triple filter, a cavity filter, a recessed filter, or a free-flow filter.

40. A method of making a cigarette, the method comprising:

(i) providing a cut filler to a cigarette making machine to form a tobacco column;

(ii) placing a paper wrapper around the tobacco column to form a tobacco rod; and (iii) attaching the cigarette filter of claim 17 to the tobacco rod using tipping paper to form the cigarette.

41. A method of smoking the cigarette of claim 2, comprising lighting the cigarette to form smoke and drawing the smoke through the cigarette, wherein during the smoking of the cigarette, the thiol-functionalized sorbent removes the at least one heavy metal constituent of mainstream smoke.

42. A cut filler composition comprising tobacco and a thiol-functionalized sorbent having at least one thioalkylsilyl compound covalently bound to an inorganic molecular sieve substrate, wherein the thiol-functionalized sorbent is capable of removing at least some of a heavy metal constituent of mainstream smoke.

* * * * *